United States Patent [19]

Vistins

[11] 4,174,542

[45] Nov. 20, 1979

[54] TEXTURED APRON

[75] Inventor: Maris Vistins, Coshocton, Ohio

[73] Assignee: Becton, Dickinson and Company, Rutherford, N.J.

[21] Appl. No.: 957,136

[22] Filed: Nov. 2, 1978

Related U.S. Application Data

[62] Division of Ser. No. 817,189, Jul. 20, 1977, which is a division of Ser. No. 767,849, Feb. 11, 1977, Pat. No. 4,089,069.

[51] Int. Cl.[2] ..... A41B 13/10

[52] U.S. Cl. ..... 2/48

[58] Field of Search ..... 2/48, 159, 161 R, 167, 2/158, 168, 169; 156/280; 428/91, 96, 507; 427/401, 390 R, 385 B; 264/306; 36/98, 4

[56] References Cited

U.S. PATENT DOCUMENTS

| | | | |
|---|---|---|---|
| 2,715,074 | 8/1955 | Hirschberger | 428/90 |
| 2,988,745 | 6/1961 | Whitley et al. | 2/48 |
| 3,026,531 | 3/1962 | Holaday | 2/167 R |
| 3,050,738 | 8/1962 | Rytina | 2/167 R |
| 3,052,799 | 9/1962 | Hollands | 2/48 |
| 3,173,150 | 3/1965 | Mohler | 2/167 R |
| 3,268,355 | 8/1966 | Brodeur | 2/167 R |
| 3,363,265 | 1/1968 | Dummire | 2/167 R |
| 3,945,049 | 3/1976 | Barlow | 2/169 |

*Primary Examiner*—Patrick D. Lawson
*Attorney, Agent, or Firm*—Kane, Dalsimer, Kane, Sullivan and Kurucz

[57] ABSTRACT

The disclosure is of an elastomer coated textile apron characterized by a textured or "wrinkle"finish. The disclosure is also of a method of manufacturing an elastomer coated textile apron with a "wrinkle" finish. In a preferred embodiment process, the method comprises forming an apron from a base fabric of a woven or knitted fabric having a fibrous, non-woven bat attached thereto and coating the apron with an elastomer in conventional manner.

4 Claims, 10 Drawing Figures

FIG. 6
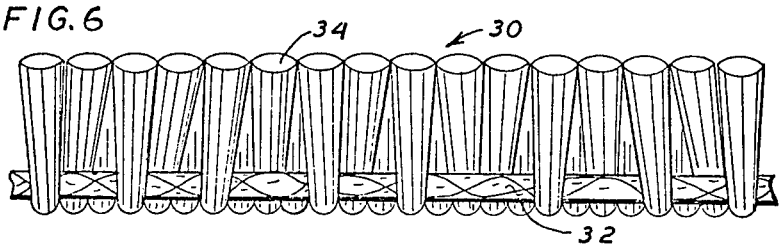
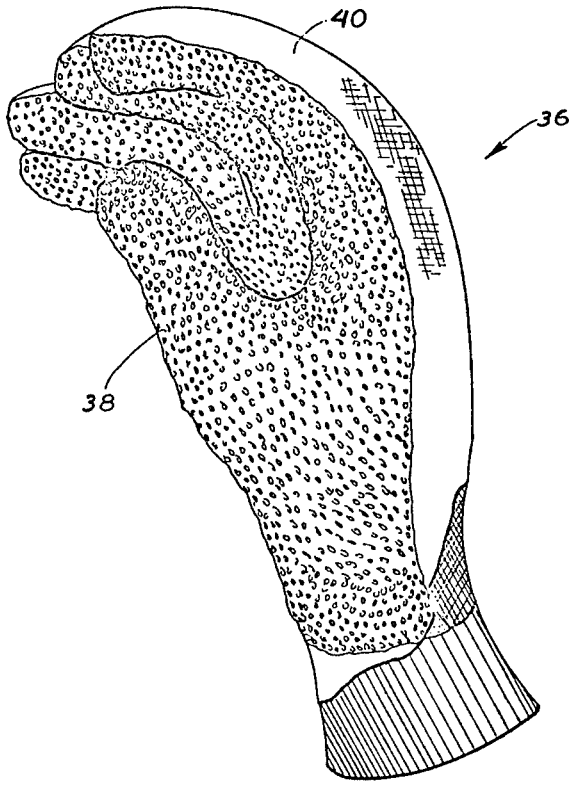
FIG. 7

TEXTURED APRON

This is a division of application Ser. No. 817,189, filed July 20, 1977 which is a division of Ser. No. 767,849, filed Feb. 11, 1977, now U.S. Pat. No. 4,089,069.

BACKGROUND OF THE INVENTION

1. Field of the Invention

The invention relates to wearing apparel and its manufacture and more particularly relates to the manufacture of elastomer coated garments.

2. Brief Description of the Prior Art

The prior art is replete with descriptions of textile wearing apparel such as gloves and their manufacture; see for example U.S. Pat. No. 3,173,150.

Elastomer coated garments such as work gloves are well known in the prior art. They are particularly useful for handling wet or toxic articles. It is particularly desirable to have a rough or wrinkle finish work garment, elastomer coated, for handling smooth articles having sharp edges such as for example, sheets of glass, castings with sharp edges and shiny metal sheets having sharp edges. For example, a wrinkle finish glove provides a higher resistance to abrasion and cutting by the sharp edges and also provides a more efficient gripping surface. The prior art method of obtaining a "wrinkle finish" on an elastomer coated textile glove comprises dipping, for example, a jersey knit fabric glove into the elastomer coating. Prior to full curing of the elastomer coating the coated glove is then dipped into a solvent which will cause the elastomer polymer to swell. This results in the wrinkle finish. The disadvantage of the prior art method resides in (1) the use of a hazardous solvent such as for example xylene, (2) the capital investment for equipment designed to handle solvent fumes and of course (3) the additional step of dipping the elastomer coated glove into the solvent. Further, the exposure of the elastomeric coating to a solvent weakens the polymer coating and reduces the life of the glove in regard to abrasion resistance. Those skilled in the art will also appreciate that the prior art method requires maturing of the elastomer latex material prior to its use. By maturing, we mean that the elastomeric coating materials generally have to be aged at elevated temperatures for varying periods of time, dependent on the temperature, batch size, mixing and like variables, prior to their being used as a textile coating if they are to wrinkle properly. Therefore one can see that "wrinkle consistency" from batch to batch is normally difficult to control.

By the method of my invention, it is not necessary to employ hazardous solvents, nor is it necessary to employ a separate dipping step to obtain the desired wrinkle finish. Further, the garment prepared according to the method of my invention has enhanced resistance to abrasion, a longer life and provides a tougher, more resilient elastomeric coating without the need of maturing the coating material. These are economic advantages to the art. In addition, the most advantageous texture is obtained in the method of the invention, using relatively low viscosity coating compositions. Therefore the elastomeric coating composition requires little adjustment in the method of the invention, thereby shortening the compounding time and simplifying the procedure of the prior art. The ability to use relatively low viscosity elastomeric coating materials also reduces the possibility of web formation between the fingers of the gloves being coated and of air entrapment in the coating. The use of low viscosity materials also improves adhesion and wear. Unexpectedly, multiple dips, which are common on heavy garments to get the desired polymer coating weight, are not required in spite of the use of low viscosity coating compositions in the method of the invention. The coating weight is controlled by web weight. Thus the method of the invention allows one to design wearing appparel in such a way that the coating polymer may be concentrated wherever its presence is desired to be enhanced. This is achieved by placing the fibrous material where heavy coating weight is desired and not where a heavier weight is a detriment, i.e.; for example in gloves at the palm and knuckle areas. Those skilled in the art will appreciate that the method of the invention provides efficient use of the coating compsitions.

In one embodiment of the invention, elastomer coated, wrinkle finish textile based garments are made from textile fabrics having an extraordinary long nap on the outer surface. In the prior art, textiles having a napped outer surface were coated with elastomeric materials by dipping. The napped surface was used primarily to improve adhesion of the elastomeric polymer film and to slightly increase the coating weight. The nap was the result of a finishing process that raises the fibers of the textile cloth by means of revolving cylinders covered with metal points or teasel burrs. Since the yarn used in the textile is generally made from twisted staple fibers, the nap is actually broken or frayed yarn which is short, with about ⅛ to ¼ inch nap height, uniform and relatively dense. In dipped glove applications, the textile napped cloth is usually cotton and therefore the nap is a fine fiber, or low denier. Cotton is preferred in such applications because of its absorbent characteristics which will cause latex to coagulate by dehydration and prevent penetration through the cloth. This coagulation effect, along with a short, fine, dense nap will cause latex to form a heavy, uniform film, especially at normal viscosities. The result is a lack of a pronounced texture.

The use of a non-woven web has many obvious differences over the use of napped textile materials. Initially, the fibers from which the web is made are preferably synthetic and therefore wet completely and do not coagulate the latex. Furthermore, the fibers are more random in nature and tangle by needling. The fiber is also generally much longer, anywhere from 0.5 to 4.0 inches in length. Fiber coarseness or denier is relatively high at 6. Any denier may be used (from 1 to 15); however the higher the denier, the greater the texture since the high denier fiber will not mat down as will the low denier fibers. In addition, the web weight or density may be varied depending on a coating weight desired. In addition, the needling of a non-woven material to a textile base has an advantage over napped materials in that excessive napping of a conventional cloth to increase nap length or weight may cause holes or tearing of the cloth.

However, as employed in one embodiment of the invention, a textured effect may be accomplished by using a base fabric with an extraordinary long nap. As an example, with a pile or plush fabric, such as a terry cloth, velvet or corduroy made with a cotton face yarn (smooth side) to stop penetration and a synthetic pile yarn (nap side) one may achieve a similar textured effect when dipped. Pile or plush weaving results in a much higher nap than a conventional cloth. In general, the pile heights are on the order of from about ⅛ inch to about 1 inch. The long nap fabric would be used in construction of garment articles where texture and extra coating weight are desired.

SUMMARY OF THE INVENTION

The invention comprises a method of manufacturing elastomer coated textile wearing apparel having a wrinkle finish, which comprises; providing a base fabric which comprises a textile fabric substrate having one napped surface, the fibrous naps having a height of from ⅛ inch to 1 inch. fabricating a garment from said base fabric; and coating the outer surface of said garment with an elastomeric resin. The invention also comprises the garment produced according to the method of the invention.

BRIEF DESCRIPTION OF THE DRAWINGS

FIG. 6 is an exploded isometric fragment view of an alternate base fabric used in the process of the invention.

FIG. 7 is a view-in-perspective of an alternate embodiment glove of the invention.

DETAILED DESCRIPTION OF THE INVENTION

Figure 1:
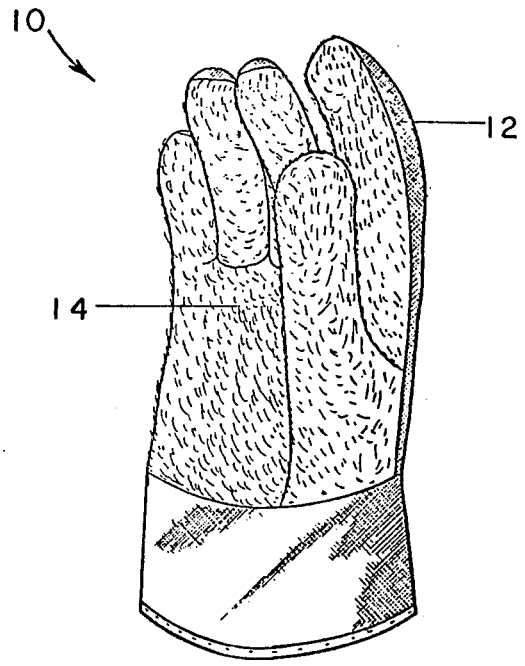
FIG. 1 is a view-in-perspective of a textile glove embodiment to be coated according to the method of the invention.
Figure 2:
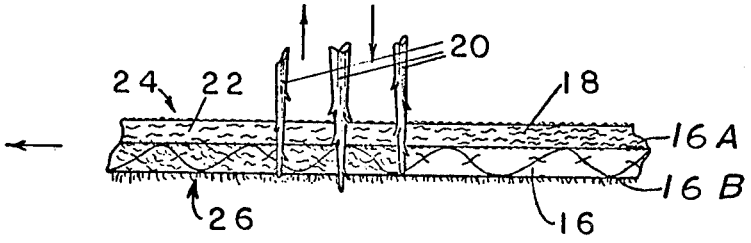
FIG. 2 is a cross-sectional side elevation of a portion of the fabric base used to construct gloves of the invention, shown partly assembled by needling.

A description of the method of the invention may be understood with reference to its application in the making of a glove. The method is carried out by first fabricating a glove 10 as shown in FIG. 1, a view-in-perspective of a textile glove to be coated as hereinafter described. The glove 10 has a back side 12 of a woven or knitted textile fabric such as a jersey knit fabric and a palm side 14 which comprises a base fabric of woven or knitted textile to which there has been needled a fibrous, non-woven textile web or bat. Although needling is preferred, the web or bat may be attached by an adhesive, by stitch bonding, quilting or any like technique. The structure of the palm side 14 may be seen in greater detail in FIG. 2, an exploded cross-sectional side elevation of a portion of the fabric base forming palm side 14 of glove 10. As shown in FIG. 2, a base or substrate 16 is formed from a woven or knitted cloth. Preferably, the cloth 16 is a knitted jersey fabric fabricated on a circular knitting machine and having a flat knit side 16A and a looped side 16B. The looped side 16B has been run through a napper to effect the loose nap surface which will comprise the inner lining side of the gloves. Also, as shown in FIG. 2, a non-woven, fibrous web 18 is being needled (in the direction of the arrow) to the substrate fabric 16 by conventional needling technique using a plurality of needles 20. The fibrous web 18 may be a non-woven web of polyester, polypropylene, or any other staple or textile fibers or blends thereof. The needled felt 22 has an upper surface of naps 24 formed by protrusion of loose fiber ends from the non-woven layer 18. The naps 26 on the lower surface 16B form the lining for the interior of the glove 10. The web 22 is anchored and the fibers thereof intertwined with the fabric of woven cloth 16 by the needling to interlock the cloth 16 with the non-woven layer 18.

The naps 24 on the upper surface of the needled felt 22 form the nap surface of the palm side 14 of the glove 10 which will be coated with elastomeric resin as will hereinafter be described more fully. The naps 24 are physically distinguishable from the naps 26 on the lower surface 16B which are formed by breaking the knitted loops of the knitted fabric cloth 16. The naps 24 being individual fiber ends of the non-woven bat 18 may be made longer than the naps 26 and possess greater tensile strength as individual fibers than the short fibers which are napped at random up from the knitted cloth 16. The fibers napped up from knitted cloth 16 are not likely to have the length or strength of the fibers making up web 18. The significance of this difference will be appreciated hereinafter.

The glove 10 as shown in FIG. 1 is ready for coating without any additional treatment. However, if desired the fabric may be first treated with conventional and known chemicals to prevent strike-through of the to-be-applied elastomeric coating. This is particularly advantageous when the coating will be of relatively low viscosity compositions. The glove 10 may be coated with an elastomeric resin following conventional techniques, such as by dipping or spraying the glove. Alternatively, the completed fabric may also be spread coated using conventional methods and a glove made from cut parts of the coated fabric. The resin coating may be any conventional elastomeric coating composition, such as a fused plastisol of polyvinyl chloride, a rubber latex or like elastomer coatings. Representative of elastomer resin compositions are the following.

A tupical formulation for a suitable plastisol coating compound is as follows:

| Material | Parts by Weight |
|---|---|
| PVC Resin | 100 |
| Plasticizer | 90–120 |
| Stabilizer | 2–4 |
| Pigments | 3 |

A representative natural rubber dip formulation is as follows:

| Material | Parts by Weight |
|---|---|
| Sulphur | 1 |
| Zinc Oxide | 3 |
| Anti-oxidant | 1.5 |
| Accelerator | 1.5 |
| Pigments, stabilizer and thickeners | 5 |
| Natural Rubber Latex | 100 |

A representative synthetic rubber dip formulation is as follows:

| Material | Parts by Weight |
|---|---|
| Neoprene Latex | 100 |
| Sulphur | .65 |
| Zinc Oxide | 3 |
| Stabilizer | .5 |

-continued

| | |
|---|---|
| Anti-oxidant | 1.3 |
| Accelerator | 3 |
| Pigment,thickeners and fillers | 5 |

After coating of the glove 10 by spraying or dipping in an elastomeric resin composition, the coated glove is generally heated to effect a cure of the resin, as is well known by those skilled in the art.

Figure 3:
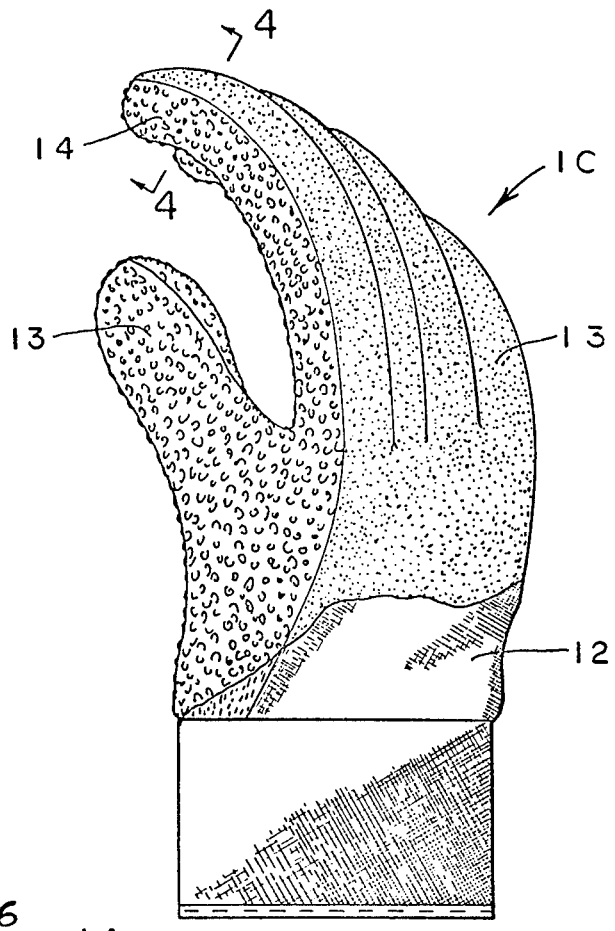
FIG. 3 is a view-in-perspective of an embodiment glove of the invention.
Figure 4:
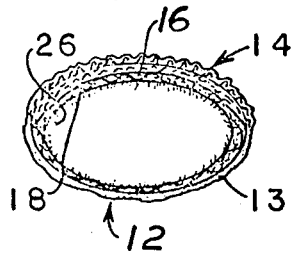
FIG. 4 is a cross-sectional view along lines 4—4 of FIG. 3.

Referring now to FIG. 3, the glove 10 can be seen after dipping in an appropriate resin composition and curing to obtain an elastomeric coating 13 over both back side 12 and palm side 14 of glove 10. Where the elastomeric coating covers the relatively smooth back side 12, a relatively smooth coating is obtained. However, where the elastomeric coating has covered the palm side 14, the wrinkle finish is obtained. The loose fibers or naps 24 on the surface of the palm side 14 upon saturation with resin leave a coarse randomly wrinkled finish thereon. Further details of the structure of coated glove 10 may be seen in FIG. 4, a cross-section along lines 4—4 of FIG. 3.

Figure 5:
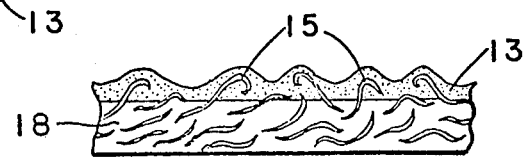
FIG. 5 is an exploded cross-sectional side elevation in part showing the relationship between the textile fabric and the elastomeric coating.

Referring now to FIG. 5, an exploded cross-sectional side elevation of a portion of the coated palm side 14, one can see how the wrinkle finish is obtained by virtue of elastomeric coating 13 entrapping fibers or naps 15 which project from the non-woven layer 18. The coarse surface caused by the raised naps 16 provide an uneven base for the resin coating 13, giving the wrinkle finish. Thus, one can see that the wrinkle finish includes encapsulated fibers 15 which also serve to reinforce and strengthen the elastomeric coating 13. It is this enhanced and reinforced elastomeric coating 13 which provides the enhanced abrasion resistance and life for the glove 10. Such reinforcement is not found in the prior art gloves and provides further anchoring and attachment of the coating 13 to the glove 10.

The following example describes the manner and process of making and using the invention and sets forth the best mode contemplated by the inventor of carrying out the invention but is not to be construed as limiting.

EXAMPLE 1

A glove is fabricated having a back side of 6 oz. plain cotton jersey with the inner, looped side napped. The palm side of the glove is fabricated from 6 oz. plain cotton jersey napped on the inner, looped side and to which there has been needled on the flat side at about 150 penetrations per square inch, a 3 oz. web of non-woven polyester fibers. The fabricated glove is dipped in a natural rubber latex and allowed to dry at 150° F. for one hour. After drying, the coated glove is cured at 230° F. for 30 minutes to obtain a wrinkle finish (palm side) elastomer coated glove.

Those skilled in the art will appreciate that many modifications may be made to the preferred embodiment described above without departing from the spirit and scope of the invention. For example, Savier jersey knit fabrics may be employed. A variety of non-woven fibrous webs such as polyamide fibers and blends thereof with polyesters may also be employed to form the palm side of the glove. In addition, it would be possible to form the web 18 on the surface of the substrate fabric 16 and needle it in place, so that the construction of web 18 is part of a continuous operation to make the glove 10.

As previously mentioned, in one embodiment of the invention, the base textile employed may have an extraordinary long nap. The use of such a base textile fabric obviates the need to needle a non-woven bat of fibrous material to the base textile. Examples of long nap textile base fabrics include pile or plush fabrics such as terry cloth, velvet or corduroy made with a cotton face yarn.

Referring now to FIG. 6, an exploded isometric fragment view of an alternate base fabric used in the process of the invention, one may see a base fabric 30 which comprises a cloth base sheet 32 having long fiber naps 34 projecting to the upper surface. This cloth may be used directly to make wrinkle finished garments of the invention, without the necessity of needling a fibrous, non-woven textile web to the upper surface. In such an instance, the base fabric 30 is used on the palm side 38 of an elastomeric coated glove 36 as shown in FIG. 7. The back side 40 of the glove may be made with the conventional jersey knit since the wrinkle finish is not desired on the back side.

As shown in FIG. 7, a view-in-perspective of an alternate embodiment glove of the invention, the extraordinary long naps or pile 34 have created the desired wrinkle finish on palm side 38 of the glove upon coating the outer surface of the glove with an elastomeric resin as previously described. In fabricating a glove 36 it is necessary that the naps 34 in the textile fabric 30 have a height of at least ⅛ inch; preferably within the range of from ⅛ inch; to about 1 inch. Shorter naps will not provide the desired wrinkle finish having the high degree of abrasion resistance while longer naps generally are unsatisfactory.

Figure 8:
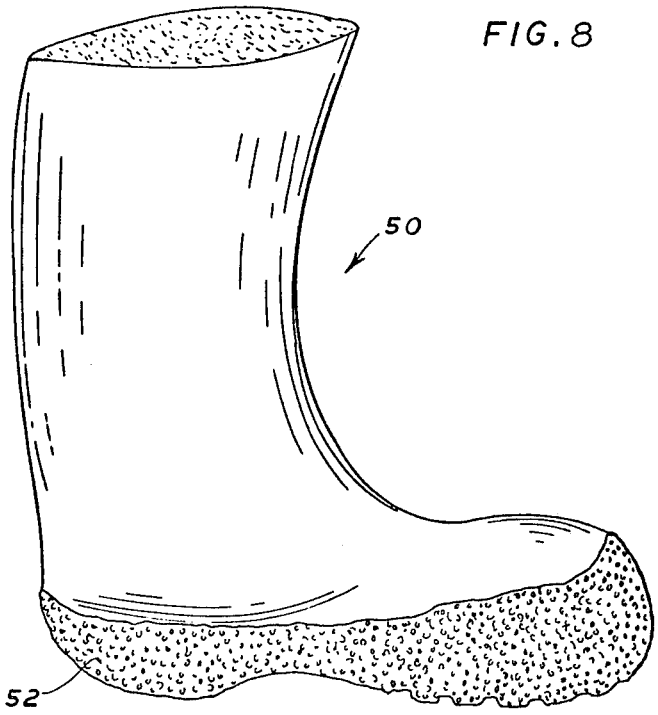
FIG. 8 is a view-in-perspective of a boot of the invention.
Figure 9:
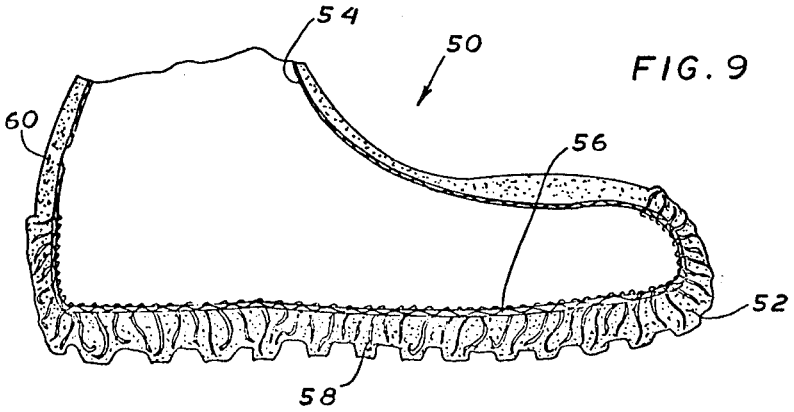
FIG. 9 is a cross-sectional side elevation of the lower part of the boot seen in FIG. 8.

Although the invention has been described above in relation to the manufacture and use of a glove, those skilled in the art will appreciate that the method of the invention may be applied to the manufacture of any garment wherein an elastomeric, wrinkle finish is desired. For example, referring now to FIG. 8, one may see a boot 50 made of a textile base and coated with an elastomeric resin. The lower wearing surface 52 of boot 50 has a wrinkle finish. As shown in FIG. 9, a cross-sectional view of the lower part of boot 50, one may see that it was manufactured essentially by the process described above in the manufacture of gloves 10 and/or 36. More specifically, as shown in FIG. 9, the boot 50 comprises an inner textile layer 54 which may be a woven or knit jersey material as previously described for the manufacture of a glove. To the wearing surface 52 of the fabric 54 there has been needled a bat of a fibrous, non-woven textile web 56, leaving projecting fibrous naps 58. The needled textile was then dipped a successive number of times in the appropriate and desired elastomeric resin as previously described for coating gloves to produce an elastomeric coating 60 on the outer surface of boot 50. The net result is a wrinkled finish 52 on the wearing surface of the boot 50.

Figure 10:
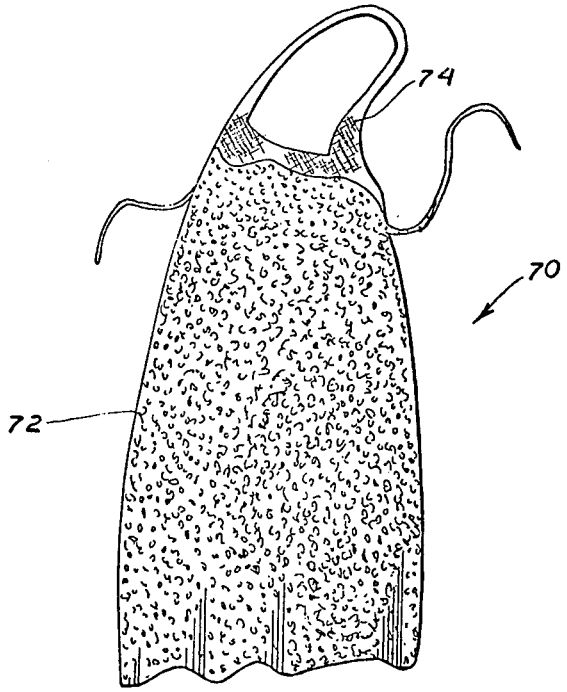
FIG. 10 is a view-in-perspective of an apron of the invention.

Referring now to FIG. 10, one may see that the method of the invention may also be applied to flat surface garments such as aprons. In FIG. 10, a view-in-perspective is seen of an apron 70 having a wrinkle finish surface 72 provided by dipping or spraying a textile apron with an appropriate elastomeric resin. The base textile fabric employed in the apron may be a long napped material as previously described or may be a woven or knit jersey fabric 74 to which there has been needled a fibrous, non-woven textile web in those areas where a wrinkle finish is desired.

What is claimed:

1. An abrasion resistant, wrinkle finish textured apron, which comprises;

a knitted textile body having the shape and size of an apron, an outer surface of which is napped to provide raised textile fibers, the raised fibrous naps having a height of from ⅛ inch to 1 inch to create an uneven base on said body; and a cured, elastomeric resin coating the base to encapsulate individual nap fibers, whereby the coating is reinforced and strengthened by the included encapsulated fibers and a wrinkle finish is obtained.

2. The apron of claim 1 wherein said resin is natural rubber.

3. An abrasion resistant, wrinkle finish textured apron, which comprises;

a knitted textile body having the shape and size of an apron;

a non-woven, fibrous web attached directly to at least a portion of the outer surface of said body, said web having component fibers projecting outwardly to create an uneven base; and a cured, elastomeric resin coating the base and encapsulating the outwardly projecting fibers, whereby the coating is reinforced and strengthened by the included encapsulated fibers and a wrinkle finish is obtained.

4. The apron of claim 3 wherein said resin is natural rubber.

* * * * *